US005520230A

United States Patent [19]

Sumner, III

[11] Patent Number: 5,520,230

[45] **Date of Patent: * May 28, 1996**

[54] POCKET CARD HOLDER WITH MONEY CLIP

[76] Inventor: Yancey Sumner, III, 7860 SW. 129 Terrace, Miami, Fla. 33156

[ * ] Notice: The portion of the term of this patent subsequent to Oct. 14, 2013, has been disclaimed.

[21] Appl. No.: 291,556

[22] Filed: Aug. 16, 1994

Related U.S. Application Data

[63] Continuation-in-part of Ser. No. 136,047, Oct. 14, 1993, Pat. No. 5,358,019, which is a continuation of Ser. No. 643,837, Jan. 22, 1991, abandoned.

[51] Int. Cl.[6] ..... A45C 11/18

[52] U.S. Cl. ..... 150/147; 150/137; 24/563; 206/38; 206/39

[58] Field of Search ..... 150/137, 147–149; 206/38, 39.3, 39.5, 39.6, 39.7

[56] References Cited

U.S. PATENT DOCUMENTS

| | | | |
|---|---|---|---|
| D. 155,927 | 11/1949 | Rothkrug | D11/78.1 |
| D. 169,825 | 6/1953 | Schildkraut | D11/78.1 |
| 685,333 | 10/1901 | Hunter | 150/147 X |
| 779,445 | 1/1905 | Willits | 206/39 X |
| 930,776 | 8/1909 | Milleson | 206/38 X |
| 1,466,729 | 9/1923 | Riley | 150/147 X |
| 1,851,013 | 3/1932 | Mechaud et al. | D11/78.1 X |
| 2,083,117 | 6/1937 | Cunningham | 266/38 R |
| 3,027,995 | 4/1962 | Littman | 206/38 |
| 3,444,914 | 5/1969 | French et al. | 150/137 X |
| 3,596,757 | 8/1971 | Cocchiaraley | 150/137 X |
| 3,679,047 | 7/1972 | Papirnyik | 206/39.5 |
| 4,056,139 | 11/1977 | Murt | 150/137 |
| 4,191,306 | 3/1980 | Rabner | 206/39.7 X |
| 4,518,080 | 5/1985 | Ohlson | 206/39 |
| 4,903,376 | 2/1990 | Rosseau | 150/137 X |
| 4,903,745 | 2/1990 | Roman | 150/137 X |
| 5,115,909 | 5/1992 | Hull et al. | 150/137 X |
| 5,125,505 | 6/1992 | Kurosaki | 206/39 X |
| 5,358,019 | 10/1994 | Sumner, III | 150/147 |

*Primary Examiner*—Sue A. Weaver
*Attorney, Agent, or Firm*—Jacobson, Price, Holman & Stern

[57] ABSTRACT

A thin flat device having a money clip on one side together with two channels on the reverse side to accommodate rigid plastic cards and the like.

13 Claims, 2 Drawing Sheets

POCKET CARD HOLDER WITH MONEY CLIP

This is a Continuation-In-Part application of application Ser. No. 08/136,047, filed on Oct. 14, 1993, now U.S. Pat. No. 5,358,019, which is a Continuation application of application Ser. No. 07/643,837, filed on Jan. 22, 1991, now abandoned.

FIELD OF THE INVENTION

The present invention relates to a rigid one piece pocket receptacle for carrying rigid plastic cards such as credit cards, I.D. cards, drivers license, etc. on one side and folded money on the reverse side.

BACKGROUND OF THE INVENTION

Modern day men's wear fashions often incorporate close fitting trousers, many without back pockets, which cannot accommodate traditional wallets or billfolds. Even mini-card cases used to facilitate the carrying of essential cash, gas, credit cards, bank cash cards, drivers license, etc. are bulky and cumbersome.

Thereafter inventors created several types of credit card holders and carriers to be carried in the pocket to accommodate credit cards and money. U.S. Pat. No. 3,444,914 to French et al. discloses a credit card carrier including an ingenuous but rather impractical mechanism to remind the owner to reinsert his card before closing. U.S. Pat. No. 4,056,139 to Murt discloses a complex device incorporating two spring clips easily compromised by wear which add unnecessary bulk to a package of money and cards. Both of these inventions incorporate two or more moving parts subject to wear or dysfunction.

SUMMARY OF THE INVENTION

Accordingly, besides the objects and advantages of a simple one piece construction, several objects and advantages of the present invention are:

(a) a slim light weight compact design;

(b) easily manipulated for extraction and insertion of cards;

(c) with a self-adjusting spring money clip to accommodate various quantities of bills;

(d) with no sharp corners to snag or tear clothing;

(e) having no moving parts to provide for long-lasting trouble-free operation;

(f) while comfortably carried in a pocket producing no unsightly bulge.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
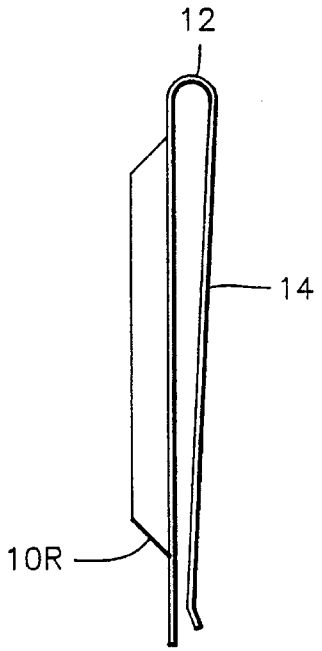
FIG. 1 is a right side view showing a card channel and its relationship to a money clip.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 4:
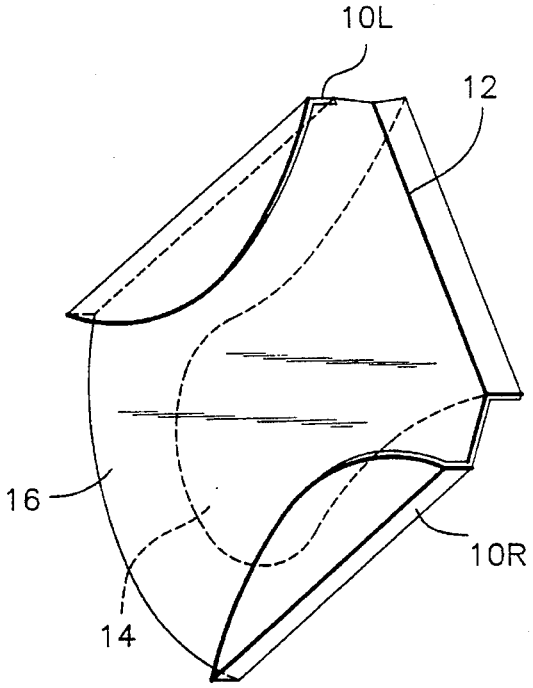
FIG. 4 is a perspective view showing the invention.
Figure 3:
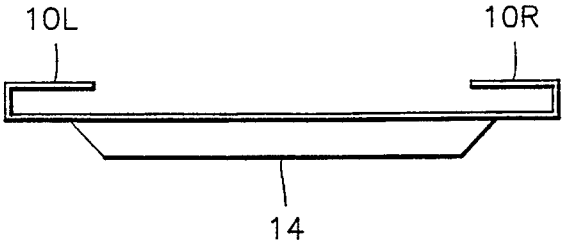
FIG. 3 is a bottom end view showing the card channels and their relationship to the money clip.

A typical embodiment of the present invention is illustrated in perspective in FIG. 4. The holder is fabricated from a flat sheet of rigid material. FIG. 3 illustrates two bends turned parallel to each other and equally distant to two identical mirrored bends forming left and right channels 10L and 10R. The distance between channels 10L and 10R is the width of the cards desired to be retained. The height of the resultant channels are such as to accommodate two or more cards (depending upon the designers choice) stacked one upon the other. FIG. 1 shows a curved bend 12, which is at a right angle and reverse to those bends fabricating channels 10R and 10L, which returns to the back side of the holder thus forming spring 12, and money clip 14 terminating in curved lip 16. It should be noted that this unique design can be accomplished in an endless number of artistic designs using various types of materials.

From the description above, a number of advantages of my design become apparent:

(a) having no moving parts, the holder will provide many years of maintenance-free use;

(b) being small and compact the holder will easily fit into a pocket without any noticeable bulge;

(c) extraction of either money or cards can easily be accomplished without disturbing the other;

(d) machine fabrication can easily accomplish the production of the design;

(e) having no sharp protruding edges, the holder will not snag or tear clothing.

Figure 2:
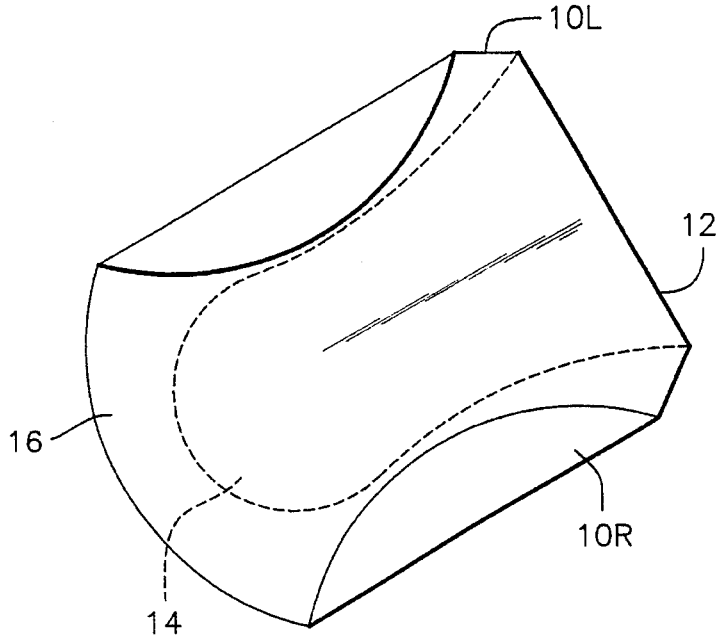
FIG. 2 is a front perspective view showing the channel to accommodate rigid plastic cards such as credit cards, drivers license, etc.

The manner of using the holder is relatively simple. To insert cards into the holder (FIG. 2), grasp the holder between the thumb and forefinger of one hand by the spring end 12 with card channels 10L, 10R facing you. With the other hand, two or three rigid plastic cards stacked one upon another are placed flat upon the lip 16 and inserted into channels 10L, 10R. Pushing the cards towards the spring end 12, the cards are held securely in place by card channels 10L, 10R.

To extract cards, the holder is held firmly between the thumb and forefinger of one hand with the cards facing you. With the thumb and forefinger of the other hand, grasp the cards and pull the cards out of the channels.

To hold paper money, using the same thumb and forefinger, flip the holder over to reveal the money clip. With the other hand, folded currency is inserted under the clip securing it for easy extraction and convenient use.

Accordingly, this invention affords the user a pocket carrier for credit cards, bank cash cards, identification cards, drivers license, business cards, etc. together with a money clip for folded currency which is:

(a) a slim light-weight compact design;

(b) easily manipulated for the extraction, insertion and use of cards;

(c) with a self-adjusting spring money clip to accommodate various quantities of bills;

(d) with no sharp corners to snag and tear clothing;

(e) having no moving parts assuring long-lasting trouble-free operation;

(f) which can be comfortably carried in a pocket producing no unsightly bulge.

In an alternative embodiment of the present invention, a pocket card holder with money clip embodying the subject invention is generally designated as 20. The holder 20 includes a generally rectangular flat base 22 having generally parallel end edges 24, 26 and perpendicular extending side edges 28, 30. The corners 32, 34 between end 24 and side edges 28, 30 are curved to avoid snagging or tearing of clothing.

Figure 6:
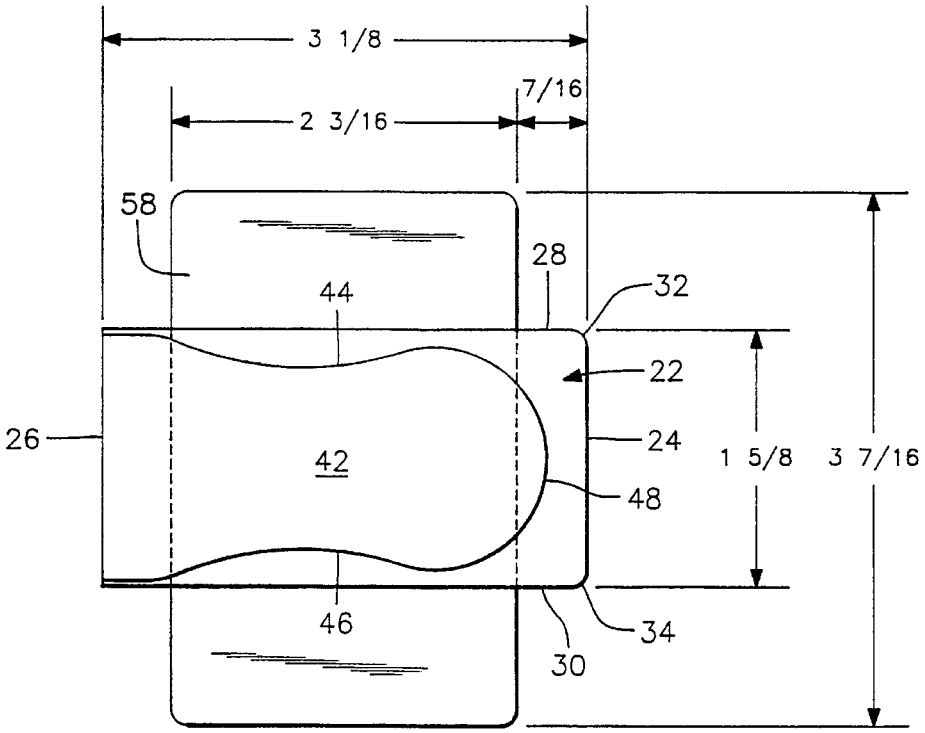
FIG. 6 is a top plan view thereof.
Figure 7:
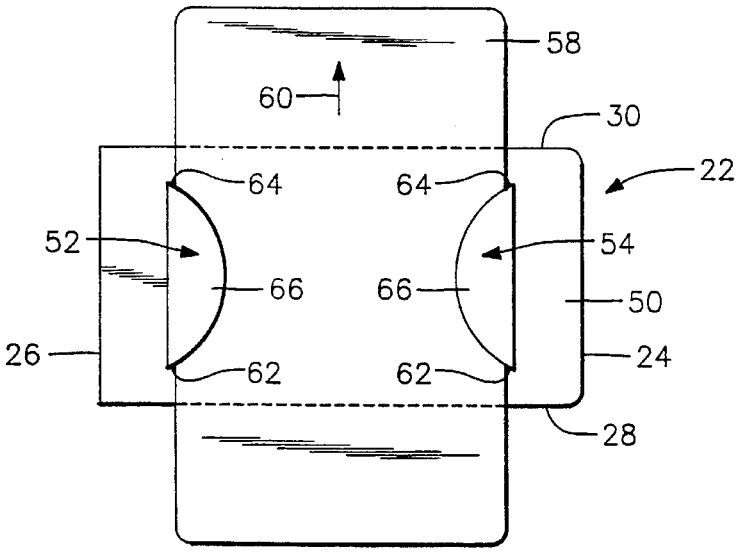
FIG. 7 is a bottom view thereof.

Extending from an upper planar surface 36 of base 22 at end 26 is a vertically-rising portion 38 extending perpendicular to surface 36. At an opposite end of section 38 is one edge 40 of money clip 42. As shown in FIG. 6, money clip 42 has generally undulating side edge surfaces 44, 46, terminating in curved lip 48.

Figure 5:
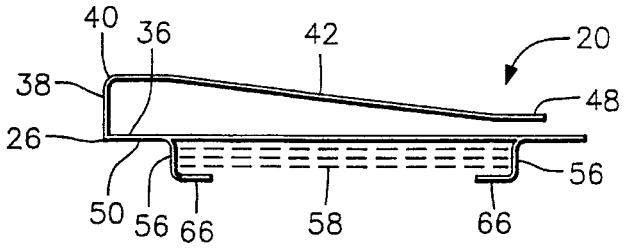
FIG. 5 is a side view of an alternative embodiment of the present invention.

As noted in FIG. 5, due to the angle of inclination of the money clip 42, the clip is biased towards the surface 36 of the base 22. Accordingly, when folded bills are inserted between the edge 48 and the surface 36 of base 22, the money clip will tend to be forced away from surface 36 but will resume a position of rest biased towards the surface 36.

Extending from an opposite, lower planar surface 50 of base 22 are two retaining members 52, 54. These retaining members are stamped from the base 22 so as to leave a void in the base 22 where the material forming the retaining members was previously located.

Each retaining member includes vertical section 56, spaced inwardly from the side edges 28, 30 of the base 22. The sections 56 are also spaced inwardly from the end edges 24, 26 of the base 22. Although extending perpendicular to the surface 50 of the base 22, sections 56 are positioned in a non-parallel configuration so that as a rigid plastic card 58 is inserted in the direction of arrow 60, the card is flexed. The distance between leading edges 62 of the sections 56 is equal to the width of the card 58 but the distance between the trailing edges 64 of the sections 56 is slightly less than the width of the rigid plastic card 58 so as to flex the card 58 and create a bow within the card to hold the card between the retaining members 52, 54 in dynamic tension.

Sections 66 of the retaining members extend perpendicular to the sections 56. Sections 66 retain the inserted rigid plastic cards 58 between the sections 56 of the rigid retaining members 52, 54.

Although the description above contains many specificities, this should not be construed as limiting the scope of the invention, but as merely providing illustrations of some of the presently preferred embodiments of the invention. For example, the height and the width of the card channels could be altered to hold more or less cards or different types of cards, such as business cards. The invention could also be designed in other shapes and sizes such as circular, trapezoidal, triangular, etc. The clip itself could be wider, longer, or shorter, etc.

Having described the invention, many modifications thereto will become apparent to those skilled in the art to which it pertains without deviation from the spirit of the invention as defined by the scope of the appended claims.

I claim:

1. A one-piece holder having a size and shape adapted to securely and simultaneously retain both flexible, foldable paper currency and rigid plastic cards, said one-piece holder comprising:

a longitudinally extending base having a first substantially planar surface and a second, opposed substantially planar surface, two opposed longitudinally extending side edges and two transversely extending end edges, said two end edges extending between respective ends of said longitudinally extending side edges, a resilient retaining member integrally formed with said base, said resilient retaining member extending from one of said two transversely extending end edges over said first substantially planar surface, said resilient retaining member being biased toward said first substantially planar surface, a leading edge of said resilient retaining member being continuously curved for avoiding snagging and tearing of clothing, and two substantially rigid retaining members integrally formed with said base, said two substantially rigid retaining members each including a first portion extending from said second, opposed substantially planar surface, defining a plane extending substantially perpendicular to said second, opposed substantially planar surface, and a second portion extending from said first portion, defining a plane extending substantially perpendicular to said first portion and extending substantially parallel to said second, opposed substantially planar surface, said second portion of said two substantially rigid retaining members terminating in continuously curved edges extending over said second, opposed substantially planar surface for avoiding snagging and tearing of clothing, and said two substantially rigid retaining members defining a retaining channel between said second, opposed planar surface and said two substantially rigid retaining members for receipt of at least one rigid plastic card therebetween.

2. A one-piece holder according to claim 1, wherein a separation distance between said first portions of said two substantially rigid retaining members is less than a width of said at least one rigid plastic card to be held therebetween so as to securely hold the at least one rigid plastic card when inserted between said first portions of said two substantially rigid retaining members.

3. A one-piece holder according to claim 2, wherein said two substantially rigid retaining members are spaced inwardly from said two transversely extending end edges.

4. A one-piece holder according to claim 3, wherein said two substantially rigid retaining members are spaced inwardly from said two opposed longitudinally-extending side edges.

5. A one-piece holder according to claim 1, wherein said two substantially rigid retaining members are spaced inwardly from said two transversely extending end edges.

6. A one-piece holder according to claim 1, wherein said two substantially rigid retaining members are spaced inwardly from said two opposed longitudinally-extending side edges.

7. A one-piece holder having a size and shape adapted to securely and simultaneously retain both flexible, foldable paper currency and rigid plastic cards, said one-piece holder comprising:

a base having a first substantially planar surface and a second, opposed substantially planar surface, two opposed longitudinally extending side edges and two transversely extending end edges, said two end edges extending between respective ends of said longitudinally extending side edges, a resilient retaining member integrally formed with said base, said resilient retaining member extending from one of said two transversely extending end edges over said first substantially planar surface, said resilient retaining member being biased toward said first substantially planar surface, a leading edge of said resilient retaining member being continuously curved for avoiding snagging and tearing of clothing, and two substantially rigid retaining members integrally formed with said base, said two substantially rigid retaining members each including a first portion extending from said second, opposed substantially planar surface, and a second portion extending from said first portion, defining a plane extending substantially parallel to said second, opposed substantially planar surface, said second portion of said two substantially rigid retaining members terminating in continuously curved edges extending over said second, opposed substantially planar surface for avoiding snagging and tearing of clothing, and said two substantially rigid retaining members being spaced apart for receiving at least one rigid plastic card in a flexed condition to hold the at least one rigid plastic card between said two substantially rigid retaining members.

8. A one-piece holder according to claim 7, wherein a separation distance between said first portions of said two substantially rigid retaining members is less than at least one rigid plastic card to be held therebetween so as to hold the at least one rigid plastic card when inserted between said first portions of said two substantially rigid retaining members for a firm grip of the at least one plastic card between said first portions of said two substantially rigid retaining members.

9. A one-piece holder according to claim 8, wherein said two substantially rigid retaining members are spaced inwardly from said two transversely extending end edges.

10. A one-piece holder according to claim 9, wherein said two substantially rigid retaining members are spaced inwardly from said two opposed longitudinally-extending side edges.

11. A one-piece holder according to claim 7, wherein said two substantially rigid retaining members are spaced inwardly from said two transversely extending end edges.

12. A one-piece holder according to claim 7, wherein said two substantially rigid retaining members are spaced inwardly from said two opposed longitudinally-extending side edges.

13. A one-piece holder having a size and shape adapted to securely and simultaneously retain both flexible, foldable paper currency and rigid plastic cards, said one-piece holder comprising:

a base having a first substantially planar surface and a second, opposed substantially planar surface, two opposed longitudinally extending side edges and two transversely extending end edges, said two end edges extending between respective ends of said longitudinally extending side edges, a resilient retaining member integrally formed with said base, said resilient retaining member extending from one of said two transversely extending end edges over said first substantially planar surface, said resilient retaining member being biased toward said first substantially planar surface, a leading edge of said resilient retaining member being continuously curved for avoiding snagging and tearing of clothing, and two substantially rigid retaining members integrally formed with said base and extending along substantially an entire length of said two opposed longitudinally extending side edges, said two substantially rigid retaining members each including a first portion extending from said second, opposed substantially planar surface, defining a plane extending substantially perpendicular to said second, opposed substantially planar surface, and a second portion extending from said first portion, defining a plane extending substantially perpendicular to said first portion and extending substantially parallel to said second, opposed substantially planar surface, said second portion of said two substantially rigid retaining members terminating in continuously curved edges extending over said second, opposed substantially planar surface for avoiding snagging and tearing of clothing, and said two substantially rigid retaining members defining a retaining channel between said second, opposed planar surface and said two substantially rigid retaining members for receipt of at least one rigid plastic card.

* * * * *